US007897233B2

(12) United States Patent
Esposito et al.

(10) Patent No.: US 7,897,233 B2
(45) Date of Patent: Mar. 1, 2011

(54) ADHESIVE ANTISKID SHEET WITH INTEGRATED GRAPHICS FEATURES

(76) Inventors: Marcelo Esposito, Oceanside, CA (US); Mark Mitsugi Takahashi, San Diego, CA (US); Erik Hoffman, Carlsbad, CA (US)

( * ) Notice: Subject to any disclaimer, the term of this patent is extended or adjusted under 35 U.S.C. 154(b) by 820 days.

(21) Appl. No.: 11/779,753

(22) Filed: Jul. 18, 2007

(65) Prior Publication Data

US 2008/0020166 A1 Jan. 24, 2008

Related U.S. Application Data

(60) Provisional application No. 60/807,835, filed on Jul. 20, 2006.

(51) Int. Cl.
*D06N 7/04* (2006.01)

(52) U.S. Cl. ..... 428/67; 428/40.1; 428/41.7; 428/42.2; 428/45; 428/47; 428/48; 428/137; 428/138; 428/141; 428/189; 428/542.6; 156/249; 156/250; 156/254; 156/263; 156/265; 156/297; 156/299; 156/300

(58) Field of Classification Search ..... None
See application file for complete search history.

(56) References Cited

U.S. PATENT DOCUMENTS

| | | | | | |
|---|---|---|---|---|---|
| 334,994 | A * | 1/1886 | Spadone | 52/179 |
| 2,106,399 | A * | 1/1938 | Beaumont et al. | 52/177 |
| 2,340,392 | A * | 2/1944 | Lefcourt | 156/220 |
| 2,756,528 | A * | 7/1956 | Silver | 40/616 |
| 3,344,011 | A * | 9/1967 | Goozner | 428/67 |
| 3,378,274 | A * | 4/1968 | Poppen | 280/18 |
| 3,438,838 | A * | 4/1969 | Fradera et al. | 428/66.7 |
| 3,687,770 | A * | 8/1972 | Chase | 156/221 |
| 3,893,252 | A * | 7/1975 | Chase | 40/773 |
| 4,289,819 | A * | 9/1981 | Kalman | 428/57 |
| 4,328,274 | A * | 5/1982 | Tarbutton et al. | 428/149 |
| 4,336,289 | A * | 6/1982 | Davis | 428/67 |
| 4,378,647 | A * | 4/1983 | Stancato | 40/773 |
| 4,379,573 | A * | 4/1983 | Lomeli et al. | 428/42.3 |
| 4,446,179 | A * | 5/1984 | Waugh | 428/31 |
| 4,615,754 | A * | 10/1986 | Waugh et al. | 156/242 |
| 4,647,000 | A * | 3/1987 | Osada | 249/83 |
| 4,777,746 | A * | 10/1988 | Brooks | 40/773 |
| 4,814,035 | A * | 3/1989 | Turner | 156/235 |
| 4,861,636 | A * | 8/1989 | Barnette | 428/42.2 |
| 5,211,593 | A * | 5/1993 | Schneider et al. | 441/65 |
| 5,320,387 | A * | 6/1994 | Carlson | 283/75 |
| 5,441,796 | A * | 8/1995 | Steidinger et al. | 428/195.1 |
| 5,622,759 | A * | 4/1997 | Fuster | 428/40.2 |
| 5,670,228 | A * | 9/1997 | Kakamu et al. | 428/49 |
| 5,974,715 | A * | 11/1999 | Werner et al. | 40/772 |
| 6,068,037 | A * | 5/2000 | Yeager et al. | 156/566 |
| 6,117,526 | A * | 9/2000 | Marks | 428/192 |
| 6,180,228 | B1 * | 1/2001 | Mueller et al. | 428/354 |
| 6,632,499 | B1 * | 10/2003 | Marks et al. | 428/42.1 |

(Continued)

*Primary Examiner* — David R Sample
*Assistant Examiner* — Jeff A Vonch
(74) *Attorney, Agent, or Firm* — Mark M. Takahashi

(57) ABSTRACT

Adhesive antiskid material suitable for use with traction sensitive applications (such as a skateboard deck) is described herein. The adhesive antiskid material includes pieces that are visually distinguishable from each other. An adhesive patch layer of the adhesive antiskid material maintains the pieces in a single sheet for handling and application to the object of interest. The adhesive antiskid material may include a graphics layer and a clear or translucent filler grip piece that is applied over the graphics layer. This option allows stickers, advertisements, company logos, pictures, or any design element to be incorporated into the adhesive antiskid material itself.

10 Claims, 7 Drawing Sheets

U.S. PATENT DOCUMENTS 6,632,506 B1 * 10/2003 Grall ..... 428/141
6,749,230 B1 * 6/2004 Casagrande ..... 283/61
6,854,748 B2 * 2/2005 Wimbish et al. ..... 280/87.042
6,905,751 B2 * 6/2005 Jauregui ..... 428/89
7,566,375 B2 * 7/2009 Huang ..... 156/63
2002/0028313 A1 * 3/2002 Blum et al. ..... 428/54
2003/0152744 A1 * 8/2003 Arena ..... 428/98
2003/0166364 A1 * 9/2003 Gamble et al. ..... 441/74
2004/0028870 A1 * 2/2004 Lehr ..... 428/67
2004/0157041 A1 * 8/2004 LeBoeuf et al. ..... 428/137
2005/0079330 A1 * 4/2005 Tanel ..... 428/204

* cited by examiner

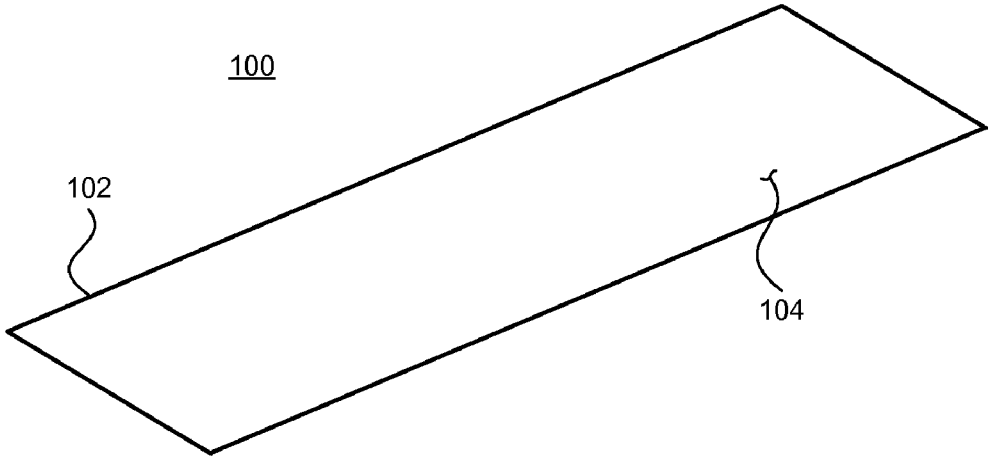
FIG. 1 – PRIOR ART
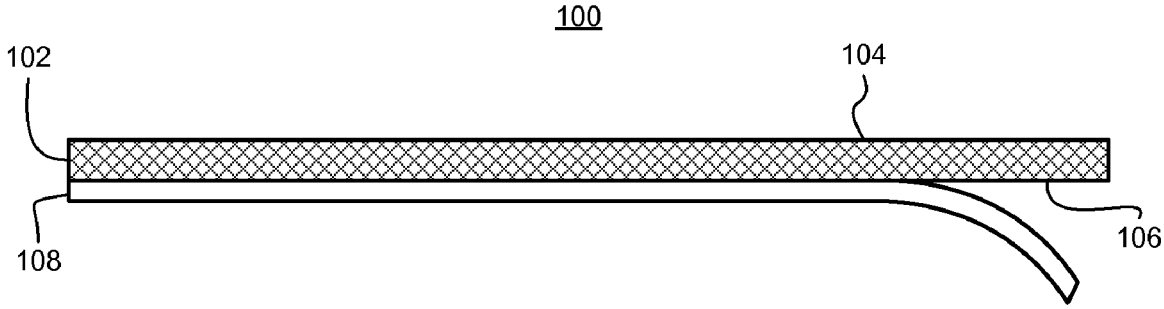
FIG. 2 – PRIOR ART

ADHESIVE ANTISKID SHEET WITH INTEGRATED GRAPHICS FEATURES

CROSS REFERENCE TO RELATED APPLICATION

This application claims the benefit of U.S. provisional patent application Ser. No. 60/807,835, filed Jul. 20, 2006 (the entire content of which is incorporated herein by reference).

TECHNICAL FIELD

The materials and techniques described herein relate generally to antiskid treatments. More particularly, the embodiments described herein relate to an adhesive antiskid sheet of the type commonly used with skateboards.

BACKGROUND

Antiskid materials, antiskid coatings, and adhesive antiskid sheets are commonly used in applications such as steps, ladders, manufacturing equipment, machinery, firearms, vehicles, exercise equipment, and sporting goods. Adhesive antiskid sheets are almost always used with skateboards. In this regard, skateboarding is a wonderful sport that has become more popular with America's youth than little league baseball, Pop Warner football, and other traditional sporting activities. A skateboard includes the following fundamental components: a deck; four wheels; and two trucks that attach the wheels to the deck and which serve as turning mechanisms for the skateboard. "Grip tape" is a form of adhesive antiskid sheet that is almost always applied to the top surface of the deck. The exposed surface of the grip tape is a gritty, sandpaper-like surface that provides friction and grip when the skateboarder stands on the deck. Historically, grip tape has been sold either in bulk rolls having a sheet width of approximately nine to twelve inches, in pre-cut rectangular sheets that contain enough area to cover the surface of one skateboard deck, or in smaller pre-cut patches (e.g., squares, rectangles, or circles).

A straightforward "grip tape job" entails applying a pre-cut deck sized sheet of grip tape onto the riding or upper surface of the skateboard deck. To accomplish this, the paper backing is removed from the entire sheet (which in most cases is approximately 9 inches wide and 36 inches long) to expose the adhesive layer. The adhesive side is then applied to the skateboard deck and the grip tape is pressed onto the deck to increase the effectiveness of the adhesive. Thereafter, the edges are trimmed around the perimeter of the deck such that virtually the entire riding surface of the deck is covered with grip tape.

Some skateboarders design creative grip tape art on their decks by painstakingly cutting pieces from large sheets of grip tape and arranging the individual pieces on their decks. For example, a skateboarder can create a checkerboard pattern on his or her deck by cutting small squares from a sheet of grip tape and placing them onto the deck in the appropriate pattern. Complicated and customized grip jobs can take many hours to complete, may require lots of trial and error, and may require more than one sheet of grip tape to complete the job. Accordingly, such individualized and one-off grip tape designs can be time consuming, expensive, and tedious. Due to the inherently short lifespan of a skateboard deck, most skateboarders would rather be spending time skateboarding than creating customized grip jobs that may only see the light of day for a month or two.

BRIEF SUMMARY

An adhesive antiskid sheet of material as described herein allows a user to quickly and easily apply graphic designs to the object upon which the adhesive antiskid sheet will be affixed, e.g., a skateboard deck. The adhesive antiskid sheet can be sold in a single sheet form having any number of individual antiskid pieces pre-assembled into a cohesive design. The configuration and lay-up of the adhesive antiskid sheet maintains the individual pieces in their desired locations relative to each other, even when the protective backing paper is removed to expose the adhesive side of the sheet. Thus, the user can apply the graphics-laden sheet to an object in a single step without having to handle, align, and apply the individual pieces.

The adhesive antiskid sheet of material described herein may contain a graphics layer having a graphic feature that is visible through a translucent or transparent piece of adhesive antiskid material. The graphic feature remains protected by the piece of antiskid material, and will be visible from the top side of the object to which it is affixed (e.g., from the top side of a skateboard deck). This graphic feature of the adhesive antiskid sheet of material can accommodate a vast number of designs, such as skateboard company logos, brand names, pictures, text, etc.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the present invention may be derived by referring to the detailed description and claims when considered in conjunction with the following figures, wherein like reference numbers refer to similar elements throughout the figures.

FIG. 1 is a perspective view of a sheet of adhesive antiskid material;

FIG. 2 is a side view of the sheet of adhesive antiskid material shown in FIG. 1;

DETAILED DESCRIPTION

Figure 3:
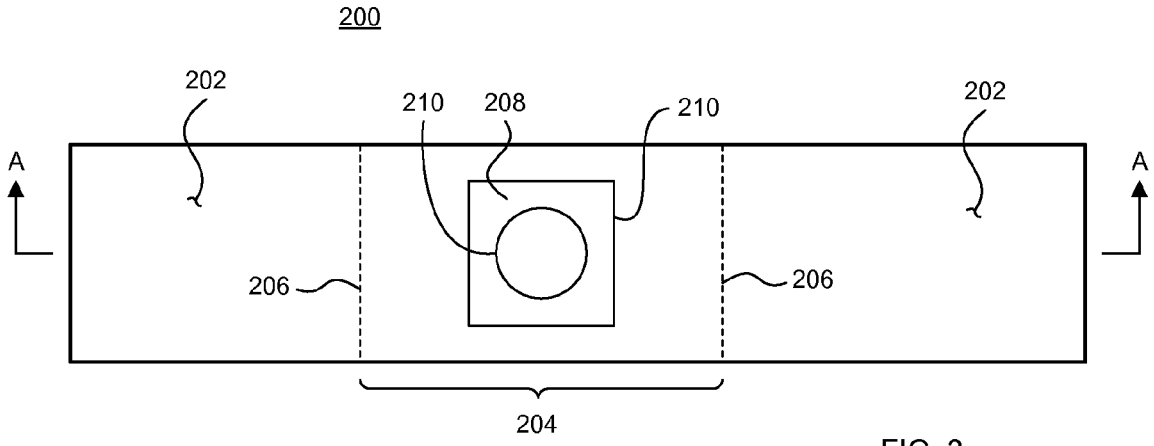
FIG. 3 is a bottom view of a sheet of adhesive antiskid material at one point in a manufacturing process.

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Relative position and location terms such as "upper," "lower," "top," and "bottom" may be used herein for consistency with the drawings and for ease of description in the context of example embodiments. The use of such terms are not intended to limit the scope or application of embodiments of the invention.

Although the following description of exemplary embodiments focuses on a skateboard application where the adhesive antiskid material is also referred to as "grip tape," the invention is not so limited. Indeed, a graphics-laden sheet of adhesive antiskid having the characteristics and properties described herein can be utilized in industrial applications (e.g., construction sites, automotive, aviation, boating), home and garden applications (e.g., stairs, basements, ladders, step stools, pool decking, walkways), recreational applications (e.g., motorcycles, trailers, bicycles, off-road vehicles, wakeboards, wake skates, personal watercraft, water skis, snowboards, firearms, archery), commercial applications (e.g., amusement parks, theaters, airplanes), and/or any place where enhanced traction, grip, or friction is desired. The following description of skateboard grip tape is merely one of many practical uses for this type of graphics-laden adhesive antiskid material.

Moreover, although the following description of exemplary embodiments focuses on a sandpaper-like adhesive antiskid material of the type commonly applied to skateboard decks and steps, other types of adhesive antiskid material are also contemplated. For example, vinyl or rubber based adhesive antiskid material of the type suitable for use with surfboards, water skis, and personal watercraft can also be manufactured and processed in the manner described herein. Likewise, foam or sponge based adhesive antiskid material of the type commonly used with surfboards can also be manufactured and processed in the manner described herein. For the sake of brevity, these specific applications are not described in detail herein; those skilled in the art will appreciate how the techniques and methodologies described for the grip tape embodiment can be extended to these other applications.

FIG. 1 is a perspective view of a sheet of adhesive antiskid material 100, and FIG. 2 is a side view of the adhesive antiskid material 100. The adhesive antiskid material 100 includes a primary grip layer 102 having an upper surface 104 and a lower surface 106, which is opposite the upper surface 104. The upper surface 104 is rough or "grippy" like sandpaper, while the lower surface 106 is sticky and adhesive. The adhesive lower surface 106 is used to adhere the adhesive antiskid material 100 onto the skateboard deck, and the roughness of the upper surface 104 provides grip for the skateboarder's shoes (or feet!). The primary grip layer 102 is typically formed from a flexible material, which may be (without limitation) rubber, plastic, or vinyl based. The primary grip layer 102 usually has a thickness of less than 0.100 inch, and a typical thickness of approximately 0.050 inch. The roughness of the upper surface 104 may be selected according to the desired application. For example, the rough upper surface 104 may have a grit measurement of about 30 to 60.

The adhesive antiskid material 100 is usually sold with a removable backing layer 108 on the adhesive lower surface 106. To apply the primary grip layer 102 to the skateboard deck, the removable backing layer 108 is peeled away from the adhesive lower surface 106 (as depicted in FIG. 2) to expose the adhesive side of the primary grip layer 102. Then, the primary grip layer 102 can be affixed to the skateboard deck and trimmed as needed. The removable backing layer 108 is usually realized as a thick piece of paper having a smooth and slick surface (for example, a very thin plastic layer or coating) for coupling to the primary grip layer 102.

Adhesive Antiskid Sheet With Integrated Graphics

Sheets of adhesive antiskid material may be processed in connection with the manufacturing of adhesive antiskid material that contains graphical components, as described more fully below. The production of a sheet of graphical adhesive antiskid material as described herein may begin with a standard sheet of adhesive antiskid material such as the adhesive antiskid material 100. In this example, the beginning sheet of adhesive antiskid material is a conventional pre-cut sheet of black adhesive antiskid material having a size of approximately 9 inches by 36 inches. Of course, many different sizes, shapes, colors, and configurations can be used. For example, the base sheet of adhesive antiskid material may be, without limitation: black; colored; translucent; clear; transparent; translucent and colored; translucent and colorless; transparent and colorless; or transparent and tinted.

The manufacturing process begins with a blank sheet of black adhesive antiskid material and a desired design, graphic, or pattern. In one embodiment, the intended pattern is generated using a suitable computer aided drawing, drafting, or design application. As described in more detail below, the intended design includes "positive space" that represents sections of the base adhesive antiskid material that will ultimately remain in the finished product, and "negative space" that represents sections of the base adhesive antiskid material that will ultimately be removed from the finished product. In the preferred embodiment, the intended design contemplates the use of filler pieces (e.g., filler grip pieces, stickers, textured cloth or velvet, metal or wood, plastic pieces, films, or the like) that replace the removed sections of the base adhesive antiskid material. In other words, these filler pieces "fill" the negative space pattern(s) in the base adhesive antiskid material. In certain embodiments, these filler pieces are of contrasting color, transparency, translucency, roughness (grit), texture, thickness, composition, and/or other characteristics relative to the base adhesive antiskid material.

In this example, a base sheet of adhesive antiskid material is provided, where the base adhesive antiskid material includes a primary grip layer having a rough upper surface, an adhesive lower surface, and a removable primary backing coupled to the adhesive lower surface. FIG. 3 is a bottom view of a sheet of adhesive antiskid material 200; this view shows the removable primary backing 202 (the primary grip layer of the adhesive antiskid material 200 is hidden from view). The removable primary backing 202 is perforated or cut to define a patch section 204 in the sheet of adhesive antiskid material 200. Notably, this perforating/cutting step is performed without cutting through the primary grip layer itself. This process step may be referred to as "kiss cutting" or "partial cutting."

The dashed lines 206 in FIG. 3 represent the kiss cuts that define the patch section 204. In practice, the layout of the patch section 204 is determined by the intended design, and the layout of the patch section 204 may be defined in an electronic drawing file, a CAD file, a CAM file, or the like.

The perforating and cutting tasks described herein may be performed using any suitable technique, including, without limitation: laser cutting; die cutting; blade cutting; water jet cutting; an/or punching. In the preferred embodiment, the kiss cutting step (and the other perforating/cutting tasks described herein) is performed using a suitably configured laser cutting system, such as the Mini 18 or the Mini 24 model laser engraving system manufactured by Epilog Laser of Golden, Colo. This and equivalent laser cutting systems are known to those skilled in the art and as such will not be described in detail herein (more detailed information about the Epilog Laser product line is available at the company website: www.epiloglaser.com). The laser cutting system can be adjusted to form perforations (a series of tiny holes), partial-depth kiss cuts, or full cuts. In one practical embodiment, the different types of cuts are formed by regulating the laser power, the speed of travel of the laser cutting beam, and/or the laser pulse frequency. Referring again to FIG. 3, the kiss cuts 206 may be formed by setting the output laser energy of the laser cutting system to an appropriate level (e.g., 20% of full power) to ensure that the removable primary backing 202 is cut or perforated while leaving the primary grip layer intact. In contrast, the full cuts may be formed by setting the output laser energy to 100% or full power.

In addition to the kiss cutting, the adhesive antiskid material 200 is also perforated or cut in an area within the patch section 204 to define a negative space pattern 208. In FIG. 3, the negative space pattern 208 resembles a square with a circle in the center of the square. In contrast to the kiss cutting, this perforating/cutting step is performed such that the primary grip layer itself is cut or perforated. This type of process step may be referred to herein as "full cutting" or "through cutting" even though in practice the primary grip layer may be perforated with a very fine laser, leaving the negative space pattern 208 somewhat connected to the remainder of the primary grip layer. This perforation technique may be desirable to enable subsequent handling of the adhesive antiskid material 200 and to facilitate easy removal of the portion of the adhesive antiskid material 200 corresponding to the negative space pattern 208 (indeed, a practical embodiment may leave this portion of the adhesive antiskid material 200 in place such that the end user can enjoy the process of creating the negative space pattern 208 and subsequently filling the negative space pattern 208 with one or more filler pieces). In one embodiment, the configuration of the laser cutting system is adjusted such that the primary grip layer is severed while leaving some of the gritty particles on the rough upper surface intact. These particles may be formed of silica, glass, metal, stone, or any hard material. Consequently, although the laser beam cuts through the flexible and thin substrate of the primary grip layer, the laser beam may not have enough energy to cut through all of the grit particles. In this fashion, "perforations" in the adhesive antiskid material 200 are automatically formed.

The solid lines 210 in FIG. 3 represent the through cuts that define the negative space pattern 208. In practice, the layout of the negative space pattern 208 is determined by the intended design, and the layout of the negative space pattern 208 may be defined in an electronic drawing file, a CAD file, a CAM file, or the like.

Figure 3A:
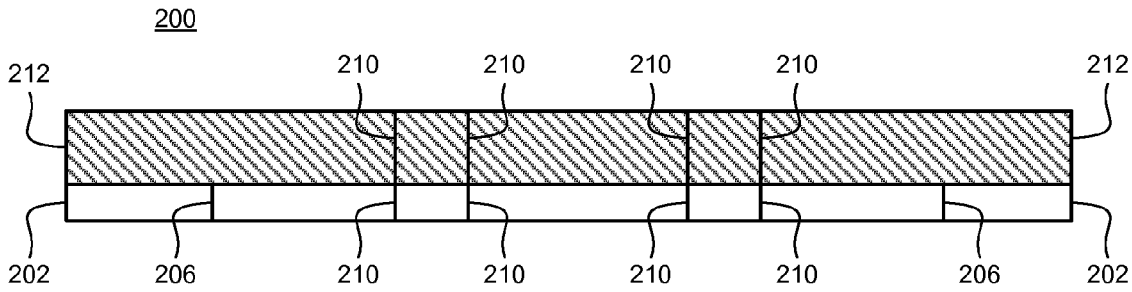
FIG. 3A is a cross sectional view of the sheet of adhesive antiskid material as viewed from line A-A in FIG. 3.

FIG. 3A is a cross sectional view of the center portion of the adhesive antiskid material 200 as viewed along line A-A in FIG. 3. FIG. 3A uses exaggerated scaling and proportions for ease of illustration and to enable the various elements to be distinguished. FIG. 3A shows the primary grip layer 212 and the removable primary backing 202 coupled to the primary grip layer 212. FIG. 3A illustrates the difference between the kiss cuts 206 and the full cuts 210.

Figure 4:
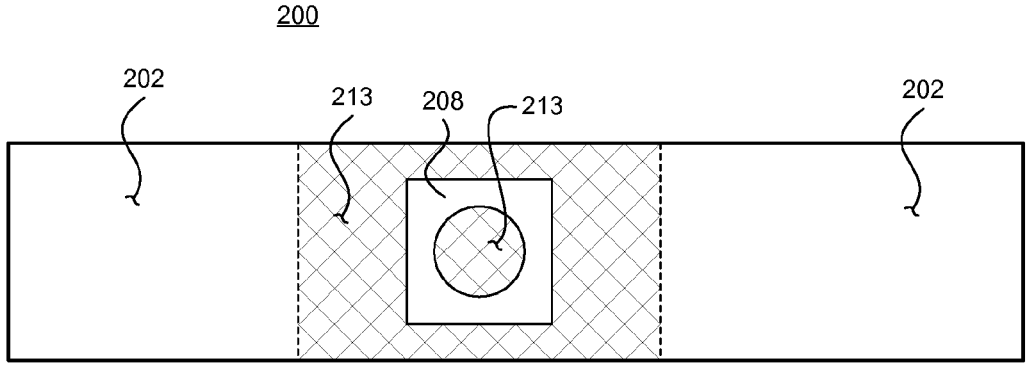
FIG. 4 is a bottom view of the sheet of adhesive antiskid material at another point in the manufacturing process.

After the kiss cuts 206 and the full cuts 210 are formed, a certain portion of the removable primary backing 202 is removed from the patch section 204, while leaving in place another portion of the removable primary backing 202 that corresponds to the desired negative space pattern 208. FIG. 4 is a bottom view of the adhesive antiskid material 200 after removal of the portion of the removable primary backing 202. In practice, the designated pieces of the removable primary backing 202 are peeled away to reveal an exposed section 213 of the sticky lower surface of the primary grip layer 212. In this example, a square frame-shaped piece and a circular piece are peeled away and discarded. The shaded area in FIG. 4 represents the resulting exposed section 213.

Figure 5:
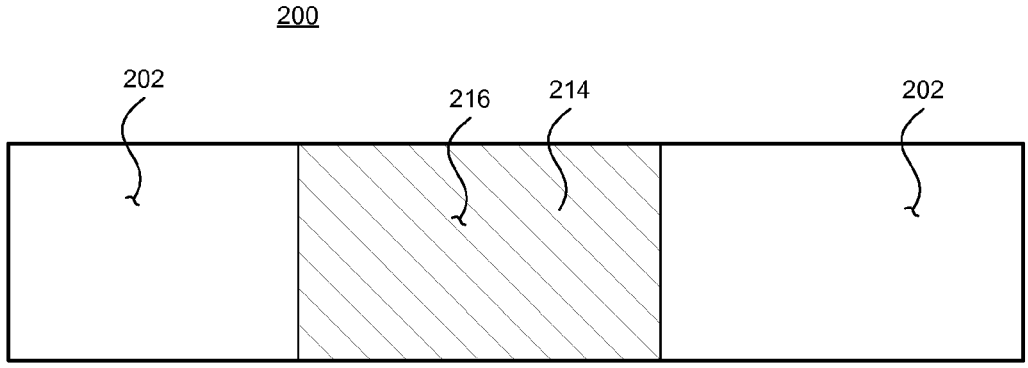
FIG. 5 is a bottom view of the sheet of adhesive antiskid material at another point in the manufacturing process.

Next, an adhesive patch layer is affixed to the exposed section 213. In one embodiment, the adhesive patch layer is trimmed or otherwise shaped to match the size of patch section 204 before it is applied to the exposed section 213. FIG. 5 is a bottom view of the adhesive antiskid material 200 after the adhesive patch layer 214 has been affixed to the exposed section 213. As shown in FIG. 5, the adhesive patch layer 214 matches the area defined by the patch section 204. In addition, the adhesive patch layer 214 spans the negative space pattern 208. In FIG. 5, the adhesive patch layer 214 actually covers the negative space pattern 208. In this embodiment, the adhesive patch layer 214 is positioned adjacent to the remaining pieces of the removable primary backing 202.

The adhesive patch layer 214 is preferably formed from a flexible adhesive-backed sheet, which may be plastic-based, vinyl-based, or the like. The adhesive patch layer 214 has an upper surface, an adhesive lower surface, and a removable patch backing 216 coupled to the adhesive lower surface. The shaded portion in FIG. 5 represents the removable patch backing 216. The upper surface is pressed against the exposed section 213 (which is sticky) to adhere the adhesive patch layer 214 to the lower surface of the primary grip layer 212. For the reasons described below, the upper surface of the adhesive patch layer 214 is non-adhesive and smooth. Notably, this creates a non-sticky junction between the upper surface of the adhesive patch layer 214 and the remaining removable backing that is attached to the lower surface of the primary grip layer 212 (this remaining removable backing corresponds to the negative space pattern 208). Depending upon the chosen graphics and/or design for the adhesive antiskid material 200, the upper surface of the adhesive patch layer 214 may be colored, white, patterned, black, etc. Moreover, the adhesive patch layer 214 itself may be translucent and colorless, transparent and colorless, translucent and colored, or transparent and colored. These options allow a section of the upper surface of the skateboard deck to be visible through the adhesive antiskid material 200 in certain embodiments (described below).

Figure 6:
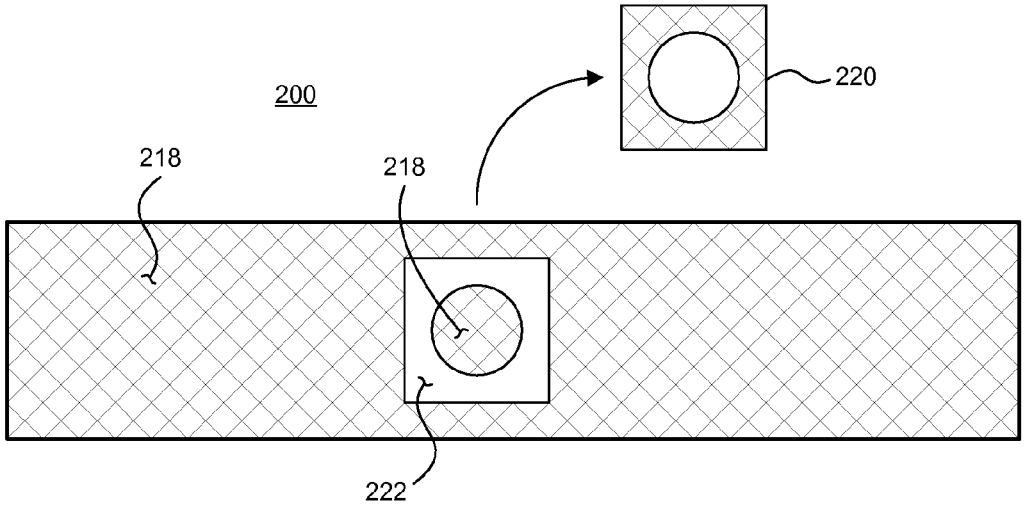
FIGS. 6-8 are top views of the sheet of adhesive antiskid material at various points in the manufacturing process.

After the adhesive patch layer 214 has been secured to the back of the adhesive antiskid material 200, a scrap piece can be removed from the adhesive antiskid material 200. FIG. 6 is a top view of the adhesive antiskid material 200 that illustrates this step. It should be appreciated that this is an optional step in the manufacturing process (explained below). In an alternate embodiment, the scrap piece is removed before the application of the adhesive patch layer 214. The shaded sections in FIG. 6 represent the rough upper surface 218 of the primary grip layer 212. Notably, the scrap piece 220 represents a positive pattern corresponding to the negative space pattern 208. In practice, the scrap piece 220 can be easily removed due to the full cuts 210 (see FIG. 1) and because the scrap piece 220 is not affixed to the adhesive patch layer 214. As explained above, the lower surface of the scrap piece 220 remains covered with a removable backing, and the upper surface of the adhesive patch layer 214 is non-adhesive. Thus, after removal of the scrap piece 220, a portion of the upper surface 222 of the adhesive patch layer 214 becomes exposed, as depicted in FIG. 6. At this point, the exposed area of the adhesive patch layer 214 corresponds to the negative space pattern 208.

A suitably configured filler grip piece may be formed or cut such that it represents the positive pattern matching the negative space pattern 208. The filler grip piece can be cut using a laser cutting system or any of the techniques mentioned above. In this example, the filler grip piece is shaped and sized like the scrap piece 220. However, the filler grip piece has a different color, roughness/grit, translucency, texture, thickness, transparency, or other distinguishing characteristic relative to the scrap piece 220. In one embodiment, for example, the rough upper surface of the primary grip layer 212 has a first color (e.g., black) and the rough upper surface of the filler grip piece has a second and different color (e.g., red). In another embodiment, for example, the primary grip layer is solid or opaque (e.g., solid black) and the filler grip piece is translucent or transparent (e.g., clear or colorless). Of course, the filler grip piece may be translucent and colorless, transparent and colorless, translucent and colored, transparent and colored, tinted, opaque and white, opaque and black, opaque and colored, etc. In alternate embodiments, the filler piece need not be an adhesive antiskid material—it can be any material, item, component, or composition having an adhesive side. For example, the filler piece may be realized as a decorative piece of adhesive cloth, velvet, canvas, or other textile. As another example, the filler piece may be realized as a sticker having a printed graphic thereon. As yet another example, the filler piece may be realized as a metal, wood, or plastic plate, puck, or medallion.

Figure 7:
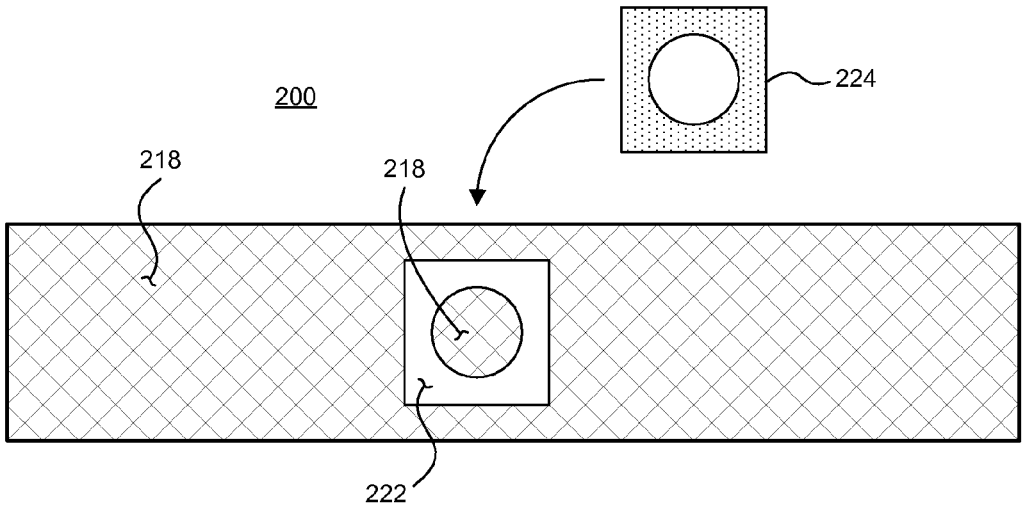

FIG. 7 is a top view of the adhesive antiskid material 200 and a filler grip piece 224. Filler grip piece 224 is shaded with specks to distinguish it from the rough upper surface 218 of the primary grip layer 212. Filler grip piece 224 may be formed from a sheet of conventional adhesive antiskid material. Thus, filler grip piece 224 may be provided with a removable backing that covers the adhesive lower surface of the filler grip piece 224. When producing the adhesive antiskid material 200, the removable backing is removed from the filler grip piece 224 to expose the sticky adhesive, and the filler grip piece 224 is applied to the exposed upper surface 222 of the adhesive patch layer 214. Pressure is applied to the upper surface of the filler grip piece 224 to ensure that it is properly seated and affixed to upper top surface 222 of the adhesive patch layer 214. This results in a stationary, stable, and fixed assembly for adhesive antiskid material 200.

Figure 8A:
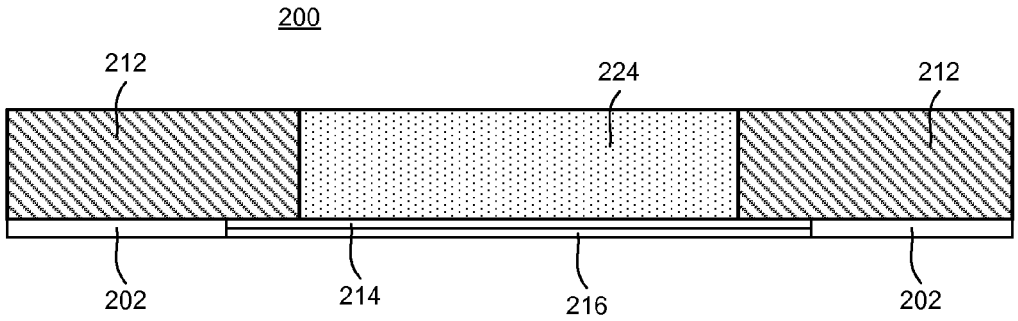
FIG. 8A is a cross sectional view of the sheet of adhesive antiskid material as viewed from line B-B in FIG. 8.
Figure 8:
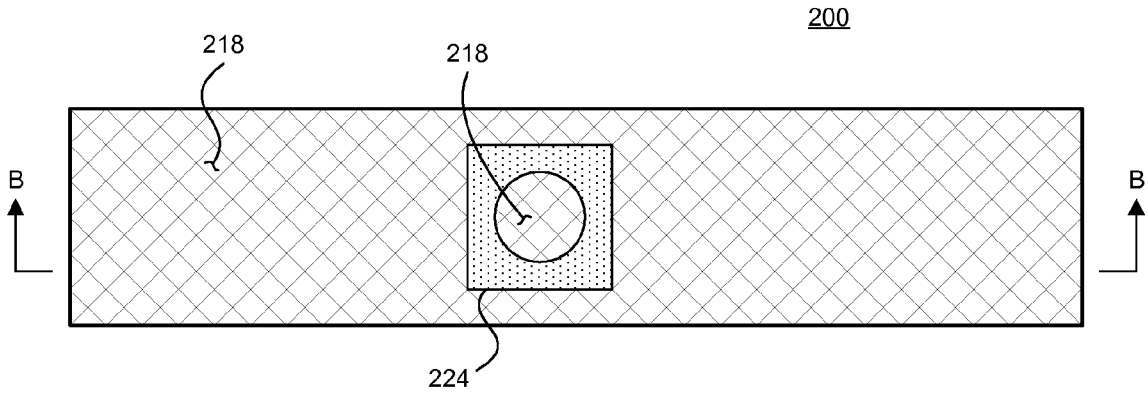

FIG. 8 is a top view of the adhesive antiskid material 200 after the filler grip piece 224 has been affixed to the adhesive patch layer 214. As shown, the filler grip piece 224 has been located within the negative space pattern 208. In this example, the filler grip piece 224 actually fills the negative space pattern 208 such that the resulting rough upper surface of the adhesive antiskid material 200 is virtually continuous with no conspicuous gaps between the rough upper surface of the filler grip piece 224 and the rough upper surface 218 of the primary grip layer 212. At this point in the process, the bottom of the adhesive antiskid material 200 remains as shown in FIG. 5, with all of the adhesive lower surfaces covered by removable backing. At this time, the adhesive antiskid material 200 can be prepared for sale and/or distribution. For example the adhesive antiskid material 200 may be: dusted off or otherwise cleaned; individually packaged for unit sales; packaged in a bulk fashion for shipping to a distribution company or a skateboard retail shop; or the like.

FIG. 8A is a cross sectional view of the center portion of the adhesive antiskid material 200 as viewed from line B-B in FIG. 8. FIG. 8A uses exaggerated scaling and proportions for ease of illustration and to enable the various elements to be distinguished. FIG. 8A depicts the primary grip layer 212 and the filler grip piece 224 within the negative space pattern 208. FIG. 8A also shows the adhesive patch layer 214 with its removable patch backing 216 still intact.

Figure 9:
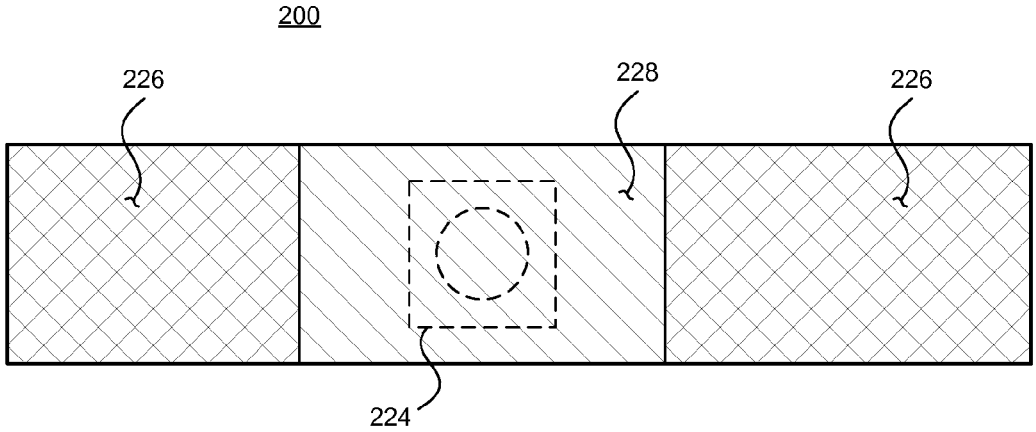
FIG. 9 is a bottom view of the sheet of adhesive antiskid material upon completion of assembly.

Notably, the application of adhesive antiskid material 200 onto a skateboard deck is virtually identical to the application of a conventional sheet of grip tape. The removable primary backing 202 and the removable patch backing 216 are removed from the lower surface of the finished adhesive antiskid material 200 to expose the adhesive lower surface of the primary grip layer 212 and to expose the adhesive lower surface of the adhesive patch layer 214. FIG. 9 is a bottom view of the adhesive antiskid material 200 after removal of the removable backing pieces. The double shaded sections in FIG. 9 represent the adhesive lower surface 226 of the primary grip layer 212, while the single shaded section in FIG. 9 represents the adhesive lower surface 228 of the adhesive patch layer 214. As described above, the adhesive patch layer 214 may completely cover the filler grip piece 224. Accordingly, FIG. 9 depicts filler grip piece 224 in dashed lines because it may be obscured by the adhesive patch layer 214.

Figure 10:
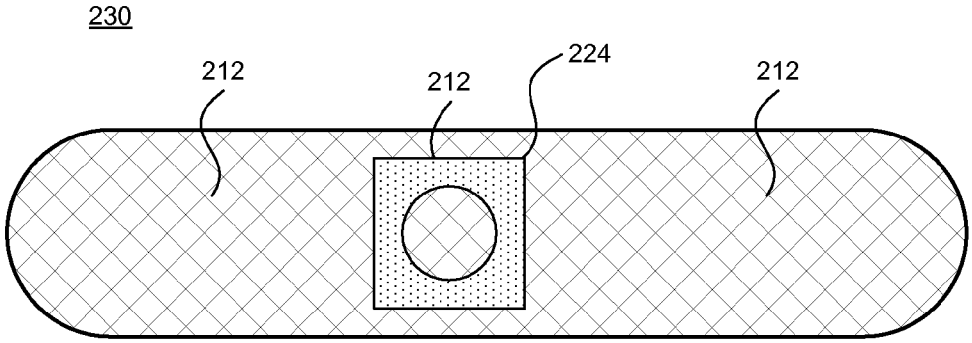
FIG. 10 is a top view of a skateboard deck with the adhesive antiskid material installed.

After the removable backing has been removed from the adhesive antiskid material 200 as shown in FIG. 9, the adhesive antiskid material 200 can be affixed to the top surface of the skateboard deck. The adhesive patch layer 214 retains the filler grip piece 224 in place relative to the primary grip layer 212, which enables the adhesive antiskid material 200 to be manipulated and applied as a single piece. As an optional step, a small amount of soapy water may be sprayed onto the deck before the adhesive antiskid material 200 is applied to facilitate placement and alignment of the adhesive antiskid material 200 and to facilitate the removal of bubbles between the adhesive antiskid material 200 and the deck. It may be desirable to initially remove only one of the removable backing pieces, such as the removable patch backing 216 in this example, to make it easier to align and position the adhesive antiskid material 200 on the deck. This single section can be affixed to the deck as an initial step, and the remaining removable backing pieces can then be removed to allow the rest of the adhesive antiskid material 200 to be affixed to the deck as explained above. Once the adhesive antiskid material 200 has been located in the desired position on the deck, pressure is applied to the adhesive antiskid material 200 to secure it firmly against the deck. Thereafter, the adhesive antiskid material 200 can be trimmed around the perimeter of the deck. FIG. 10 is a top view of a skateboard deck 230 after application and trimming of the adhesive antiskid material 200.

Referring again to FIG. 5, FIG. 8, and FIG. 8A, the adhesive antiskid material 200 produced by the technique described herein generally includes a primary grip layer 212, at least one filler grip piece 224, at least one adhesive patch layer 214, removable primary backing 202 for the primary grip layer 212, and removable patch backing 216 for the at least one adhesive patch layer 214. For the sake of simplicity and for consistency with the illustrated example, only one filler grip piece 224 and only one adhesive patch layer 214 are described below. The primary grip layer 212 has a rough "grippy" upper surface and a sticky lower surface that is opposite its rough upper surface. The finished adhesive antiskid material product includes a negative space pattern 208 formed within the primary grip layer 212, where the filler grip piece 224 corresponds to the negative space pattern 208. In this regard, the filler grip piece 224 is located within the negative space pattern 208 (in this embodiment, the filler grip piece 224 fills the negative space pattern 208). The filler grip piece 224 has a rough "grippy" upper surface and an adhesive lower surface that is opposite its rough upper surface.

The adhesive patch layer 214 has an upper surface that is non-adhesive and a sticky and adhesive lower surface that is opposite its non-adhesive upper surface. As shown in FIG. 8A, at least a portion of the upper surface of the adhesive patch layer 214 is affixed to the adhesive lower surface of the filler grip piece 224. In this particular example, another portion of the upper surface of the adhesive patch layer 214 is affixed to an area of the adhesive lower surface of the primary grip layer 212. In other words, a first area of the upper surface of the adhesive patch layer 214 is affixed to the primary grip layer 212, while a second area of the upper surface of the adhesive patch layer 214 is affixed to the filler grip piece 224. This arrangement results when the patch section 204 (see FIG. 3) is larger than the negative space pattern 208 and when adhesive patch layer 214 overlaps the negative space pattern 208.

The removable primary backing 202 is adhered and coupled to specific areas of the adhesive lower surface of the primary grip layer 212, and the removable patch backing 216 is adhered and coupled to the adhesive lower surface of the adhesive patch layer 214. As described above, the removable primary backing 202 and the removable patch backing 216 are formed from a suitable material that allows easy removal to expose the sticky adhesive surfaces. In certain embodiments, the filler grip piece 224 is translucent or tinted, and the upper surface of the adhesive patch layer 214 is white, black, colored, tinted, or shaded to enhance or otherwise influence a translucence or tinting effect of the filler grip piece 224 (this influence results because the upper surface of the adhesive patch layer 214 is pressed against the filler grip piece 224 as illustrated in FIG. 8A). For example, the filler grip piece 224 may be formed from a translucent red material. Thus, if the upper surface of the adhesive patch layer 214 is white, then the filler grip piece 224 will appear as a relatively bright and consistent red component; if the upper surface of the adhesive patch layer 214 is gray, then the filler grip piece 224 will appear as a relatively dull and consistent red component; if the upper surface of the adhesive patch layer 214 is blue, then the filler grip piece 224 may appear to be purple; and if the upper surface of the adhesive patch layer 214 is patterned, then that pattern may appear through the filler grip piece 224.

Figure 11:
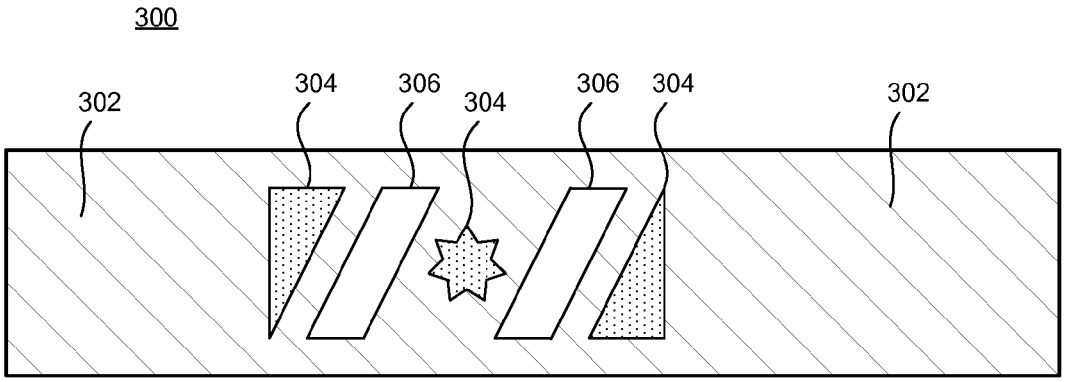
FIG. 11 is a top view of another sheet of adhesive antiskid material configured in accordance with an embodiment of the invention.

As mentioned above, an embodiment may include any number of filler pieces, and all of the filler pieces need not be of the same color, translucence, shape, grit, texture, composition, configuration, or characteristic. For example, the negative space pattern may include a plurality of separate and distinct negative space patterns formed in the primary grip layer, and the grip tape may utilize a plurality of separate and distinct filler pieces. Although not a requirement, in one embodiment, the number of negative space patterns equals the number of filler pieces. FIG. 11 is a top view of another sheet of adhesive antiskid material 300 that illustrates this concept. The adhesive antiskid material 300 uses a primary grip layer 302 as a foundation. The primary grip layer 302 includes five separate negative space patterns of different shapes and sizes. The adhesive antiskid material 300, however, only includes three filler grip pieces 304 (which may or may not be of the same color, translucence, opaqueness, etc.). The remaining two negative space patterns 306 do not contain filler grip pieces. If desired, the adhesive patch layer under these negative space patterns 306 can be trimmed out before or after application of adhesive antiskid material 300 such that the top surface of the skateboard deck will be visible through these "windows" after the adhesive antiskid material 300 is applied. In an embodiment that utilizes an adhesive patch layer that is translucent and colorless, transparent and colorless, translucent and colored, or transparent and colored, the top surface of the skateboard deck will be visible through the adhesive patch layer itself. In such an embodiment, the adhesive patch layer also serves as a protective layer for the top surface of the skateboard deck, which may contain printed or painted graphics, a pattern, or a design.

In an alternate embodiment, a sheet of adhesive antiskid material as described above may be distributed with the scrap piece(s) intact within the primary grip layer. The respective filler piece(s) can be packaged with the sheet of adhesive antiskid material to form a kit. Such a kit allows the skateboarder to play a role in making the grip art on the skateboard deck, and facilitates optional installations of the adhesive antiskid material. For example, the user may wish to leave the scrap pieces intact, resulting in a single-color grip job (the outline of the scrap pieces may be visible in the primary grip layer). Alternatively, the user may wish to remove a scrap piece, but leave the resulting negative space pattern unfilled. In such an installation, the user may also decide to trim or remove the adhesive patch layer from the negative space pattern so that the skateboard deck will show through the resulting "window." Moreover, different colors or styles of filler pieces can be provided in the kit, allowing the user to select a desired color scheme for the grip job.

Grip Tape Sheet With Integrated Printed Graphics

Figure 12:
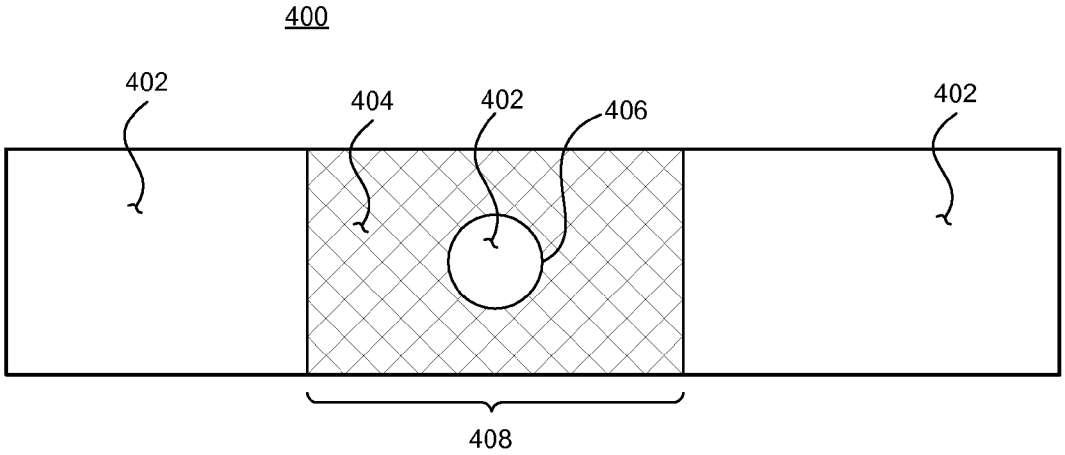
FIG. 12 is a bottom view of yet another sheet of adhesive antiskid material at one point in a manufacturing process.

The technique described above can be modified slightly to produce a sheet of adhesive antiskid material that incorporates a graphics layer having a graphic feature (or features) that is at least partially visible through a filler grip piece. FIG. 12 is a bottom view of a sheet of adhesive antiskid material 400 that has been processed to a point equivalent to that shown in FIG. 4. In other words, the kiss cuts and the through cuts have already been formed, and a section of the removable primary backing 402 has already been removed to expose some of the adhesive lower surface 404 of the primary grip layer. This simple example includes a circular negative space pattern 406 formed within the primary grip layer. As explained below, an intended graphics feature influences the size, shape, and layout of the negative space pattern 406 and, therefore, influences the step of perforating or cutting the base sheet of adhesive antiskid material within a patch section 408 to define the negative space pattern 406. Moreover, the size and shape of the negative space pattern 406 may be based upon the graphics feature itself (as illustrated in this example, and as described in more detail below). In this embodiment, the negative space pattern 406 ultimately serves as the border of a viewing "window" for the graphics feature.

Figure 14:
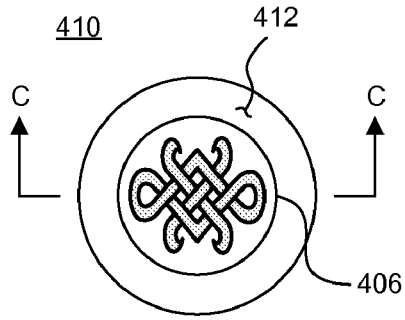
FIG. 14 is a top view of a graphics layer suitable for use with a sheet of adhesive antiskid material.
Figure 15:
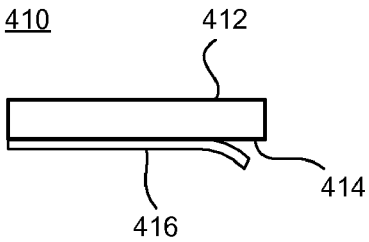
FIG. 15 is a cross sectional view of the graphics layer as viewed from line C-C in FIG. 14.

Before applying an adhesive patch layer to the adhesive antiskid material 400 (as described above with respect to FIG. 5), a suitably configured graphics layer is provided. FIG. 14 is a top view of one graphics layer 410 suitable for use with this example embodiment, and FIG. 15 is a cross sectional view of the graphics layer 410 as viewed along line C-C in FIG. 14. FIG. 15 uses exaggerated scaling and proportions for ease of illustration and to enable the various elements to be distinguished. In this example, the graphics layer 410 has an upper surface 412, an adhesive lower surface 414 opposite the upper surface 412, a removable graphics layer backing 416 coupled to the adhesive lower surface 414, and a graphic feature 418 on the upper surface 412. The graphics layer 410 can be realized in any suitable fashion. For example, the graphics layer 410 may be realized as a paper, plastic, vinyl, metallic foil, or other type of sticker having a desired graphic design, pattern, text, or the like printed on the upper surface 412. The graphics layer 410 may be realized as an adhesive-backed label that is commonly available in shapes and sizes that facilitate easy formatting and printing using standard computer and printer systems. The use of such labels enables quick and easy customization or design of the graphics layer 410 using well known computer software and printing capabilities. For instance, the desired graphic feature 418 can be produced in electronic form and printed onto a suitably configured label using a color printer or a black and white printer. The printed label can then function as the graphics layer 410.

Figure 13:
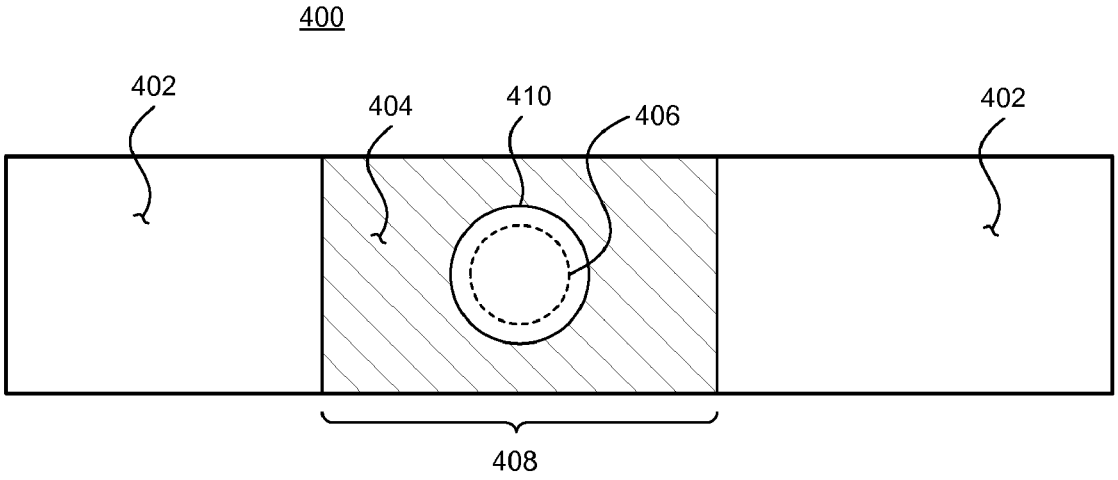
FIG. 13 is a bottom view of the sheet of adhesive antiskid material at another point in the manufacturing process.

The graphics layer 410 may be the same size of the negative space pattern 406 or it may be larger in area than the negative space pattern 406. In this embodiment the adhesive antiskid material 400 utilizes a graphics layer 410 that is larger than the negative space pattern 406, as shown in FIG. 13 (where the negative space pattern 406 is depicted in dashed lines to indicate that it is covered by the graphics layer 410). FIG. 13 illustrates the step of positioning the graphics layer 410 such that the graphic feature 418 faces the portion of the removable primary backing 402 corresponding to the negative space pattern 406. In this example, the graphics layer 410 is positioned such that its upper surface covers the negative space pattern 406 and such that a section of its upper surface becomes affixed to the exposed section of the adhesive lower surface 404 of the primary grip layer. In other words, part of the graphics layer 410 overlaps the exposed adhesive lower surface 404, which helps retain the graphics layer 410 in position during subsequent handling of the adhesive antiskid material 400.

The removable graphics layer backing 416 (if applicable) may be retained or it may be removed. In the preferred embodiment, the removable graphics layer backing 416 is removed to expose the sticky lower surface of the graphics layer 410. Next, a suitably sized and configured adhesive patch layer is applied to the adhesive antiskid material 400 in a manner equivalent to that described above for the adhesive antiskid material 200. As described above, the adhesive patch layer may be translucent and colorless, transparent and colorless, translucent and colored, or transparent and colored (to facilitate visibility of the skateboard deck in certain embodiments). Notably, the adhesive patch layer is affixed to the exposed adhesive lower surface 404 of the primary grip layer and to the adhesive lower surface 414 of the graphics layer 410. After this step, the bottom of the adhesive antiskid material 400 will resemble that shown in FIG. 5. Thereafter, the "positive" scrap piece of the primary grip layer is removed and replaced with a suitably sized, shaped, and configured filler piece in a manner equivalent to that described above for the adhesive antiskid material 200.

Figure 16:
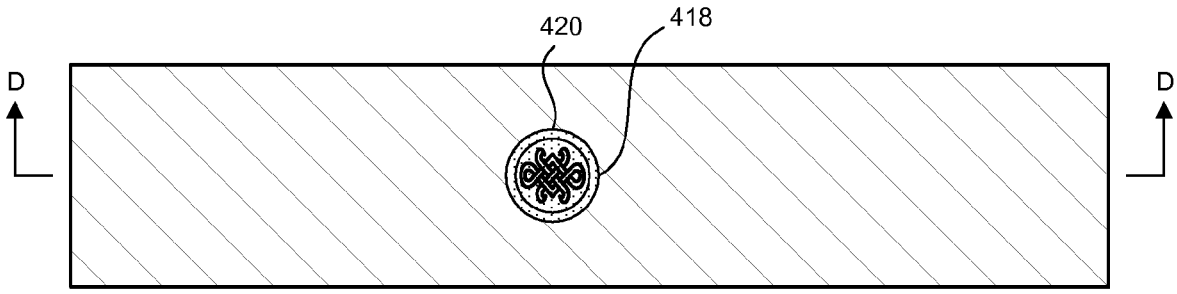
FIG. 16 is a top view of the sheet of adhesive antiskid material upon completion of assembly.
Figure 17:
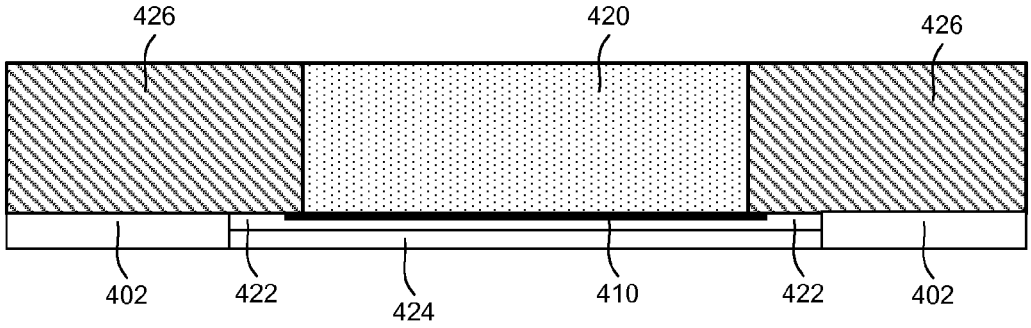
FIG. 17 is a cross sectional view of the sheet of adhesive antiskid material as viewed from line D-D in FIG. 16.

FIG. 16 is a top view of the adhesive antiskid material 400 after the filler grip piece 420 has been installed and secured to the upper surface of the graphics layer 410, and FIG. 17 is a cross sectional view of the center portion of the adhesive antiskid material 400 as viewed from line D-D in FIG. 16. FIG. 17 uses exaggerated scaling and proportions for ease of illustration and to enable the various elements to be distinguished. FIG. 17 shows the adhesive patch layer 422 and its removable patch backing 424. As best depicted in FIG. 17, the graphics layer 410 is located between the filler grip piece 420 and the upper surface of the adhesive patch layer 422. Moreover, in this embodiment the graphics layer 410 has a first portion that is located between the primary grip layer 426 and the upper surface of the adhesive patch layer 422, and a second portion that is located between the filler grip piece 420 and the adhesive patch layer 422. The first portion of the graphics layer 410 represents the portion that extends beyond the negative space pattern 406 and overlaps with the primary grip layer 426. Notably, the graphic feature 418 should be located on the second portion so that it is not obscured by the primary grip layer.

The filler grip piece 420 is suitably configured to facilitate visibility of the graphic feature 418. As depicted in FIG. 16, the adhesive antiskid material 400 is produced such that the graphic feature 418 is at least partially visible through the filler grip piece 420. The specks in FIG. 16 identify the filler grip piece 420—in this example the filler grip piece 420 fills the negative space pattern 406 and covers the graphics layer 410. Depending upon the particular implementation, the filler grip piece 420 may be, without limitation: translucent and colorless; translucent and colored; transparent and colorless; transparent and colored; tinted; etc. The light transmission characteristics of the filler grip piece 420 can be selected to allow the desired amount of visibility of the graphic feature 418. For example, maximum visibility may be achieved if the filler grip piece 420 is formed from a stock of clear grip tape.

The outline of the filler grip piece 420 and/or the outline of the corresponding negative space pattern 406 may be formed in accordance with the particular graphic feature 418. FIG. 16 illustrates this concept, where both the filler grip piece 420 and the negative space pattern 406 are circular to accommodate the circular outline of the graphic feature 418. In this example, the filler grip piece 420 and the negative space pattern 406 each have a slightly larger diameter than the graphic feature 418. This results in a clean and visually appealing finished product. Of course, this concept can be extended to more complex outlines. For example, the graphic feature 418 may be a photograph of a person and the filler grip piece 420 and the negative space pattern 406 can be formed to trace or follow the general outline shape of the person.

Notably, the application of the adhesive antiskid material 400 to a skateboard deck is virtually identical to the application of a conventional sheet of grip tape. The removable primary backing 402 and the removable patch backing 424 are removed from the lower surface of the finished adhesive antiskid material 400 to expose the adhesive lower surface of the primary grip layer 426 and to expose the adhesive lower surface of the adhesive patch layer 422. Thereafter, installation of the adhesive antiskid material 400 is similar to that described above for the adhesive antiskid material 200. Thus, company logos, trademarks, branding graphics, pictures, advertisements, and other graphics can be seen from the top surface of a skateboard deck rather than the bottom surface of the deck, which is usually hidden from view and which quickly becomes scratched and defaced after use. The filler grip piece 420 functions to provide additional grip for the skateboarder. In addition, the filler grip piece 420 protects the graphic feature 418 in a pristine condition for the life of the adhesive antiskid material 400 (which typically corresponds to the life of the skateboard deck).

An alternate embodiment of the adhesive antiskid material 400 utilizes a graphics layer 410 (e.g., a sticker) that is the same size or smaller than the negative space pattern 406. In such an embodiment, the graphics layer 410 can be installed from the top side of the adhesive antiskid material 400 after the scrap piece has been removed from the primary grip layer. Once the scrap piece is removed, the upper surface of the adhesive patch layer will be exposed, and the graphics layer 410 can be affixed within the negative space pattern 406. Thereafter, the filler grip piece 420 can be installed as described above.

Adhesive Antiskid Sheet Variations

Clear Adhesive Patch Layer—As mentioned briefly above, an adhesive antiskid material sheet configured in accordance with the invention may utilize an adhesive patch layer that is translucent and colorless, transparent and colorless, translucent and colored, or transparent and colored. Such an adhesive patch layer allows the top surface of the skateboard deck (which may contain graphics, a design, a pattern, a sticker, or the like) to be viewed through the adhesive patch layer and through the negative space pattern formed in the primary grip layer. The adhesive patch layer will also serve as a protective layer for the top surface of the skateboard deck, thus preserving any underlying graphics. A filler piece need not be employed in such an embodiment. If desired, however, a filler grip that is translucent and colorless, transparent and colorless, translucent and colored, or transparent and colored can be installed within the negative space pattern. Consequently, the top surface of the skateboard deck will remain visible through the adhesive patch layer, the negative space pattern, and the filler grip piece. During manufacturing, the layout of the adhesive antiskid material sheet can be selected to match and/or align with graphics that may be included on the top surface of the skateboard deck. In particular one or more of the following items may be influenced by the graphics on the deck: the location, shape, and size of the patch section; the location, shape, and size of the negative space pattern; the location, shape, and size of the filler grip piece; the translucence or transparence properties of the adhesive patch layer; and the translucence or transparence properties of the filler grip piece. For example, a specific brand, line, or model of a skateboard deck may be printed with a particular graphic on the top surface of the deck (where that graphic is consistent from one deck to another). In that scenario, the grip tape sheet can be customized for the particular deck such that the graphics on the top surface of the deck can be easily aligned with the negative space pattern in the grip tape sheet.

Customized Shop Grip Tape—Skateboard retail shops usually sell and install a sheet of grip tape with each new skateboard deck. Some shops sell and install grip tape with a die-cut logo of the shop, a die-cut logo of a skateboard equipment manufacturer, a die-cut logo of a skateboard equipment brand, or the like. In this regard, a sheet of grip tape configured in accordance with an embodiment of the invention is suitable for use as shop grip tape. The shop grip tape can be manufactured substantially as described above. However, the shop grip tape need not utilize an adhesive patch layer or a patch section formed in the primary grip layer. Rather, the shop grip tape can be produced with a suitably sized, shaped, and located negative space pattern formed in the primary grip layer, where the negative space pattern is based upon the size and shape of shop stickers that contain the shop logo. The primary grip layer may be distributed to the shop with the scrap grip piece intact within the negative space pattern. Leaving the scrap grip piece intact will allow the shop to install the shop grip tape as a one-piece and single-colored sheet if the purchaser prefers to not have the shop sticker installed. The primary grip layer may also be distributed to the shop with one or more filler grip pieces that are translucent and colorless, transparent and colorless, translucent and colored, or transparent and colored. Thus, the shop can remove the scrap grip piece, affix the sheet of shop grip tape to the new skateboard deck, adhere a shop sticker to the top surface of the deck in the negative space pattern, and cover the shop sticker with a filler grip piece. The filler grip piece allows the shop sticker to be viewed from the top of the deck, while providing grip for the skateboarder and providing protection for the sticker. This grip tape embodiment is easy to manufacture because it need not require an adhesive patch layer, and this embodiment is attractive to shops because it provides a way for the shops to advertise using their shop stickers.

Sticker Window—A sheet of adhesive antiskid material configured in accordance with an embodiment of the invention may be designed to accommodate the placement of stickers by the end user. This version of the adhesive antiskid material can be manufactured substantially as described above. The size, shape, and location of the negative space pattern formed in the primary grip layer is chosen to accommodate one or more stickers, which can be applied by the consumer, a retail shop that installs the grip tape, a skateboard manufacturer or distributor, or any end user. The adhesive patch layer may be translucent, transparent, white, black, colored, colorless, etc. The adhesive antiskid material may be distributed with the scrap grip piece intact within the negative space pattern for the reasons described above for the shop grip tape version. The primary grip layer may also be distributed with one or more filler grip pieces that are translucent and colorless, transparent and colorless, translucent and colored, or transparent and colored. Thus, the end user can remove the scrap grip piece (if needed), affix the sheet of adhesive antiskid material to the skateboard deck, adhere a sticker to the top surface of the adhesive patch layer that is exposed within the negative space pattern, and cover the sticker with the filler grip piece. Alternatively, the sticker and the filler grip piece are applied before the sheet of adhesive antiskid material is affixed to the deck. The filler grip piece allows the sticker to be viewed from the top of the deck, while providing grip for the skateboarder and providing protection for the sticker.

Writing in the Filler Grip Piece—A translucent filler grip piece (colored or colorless) may be further processed to create laser writing that is visible in the finished product. The laser tool described above can be used as a scribe to write any string of symbols or characters and/or to draw any design in the filler grip piece itself. Depending upon the particular manufacturing process, the writing may be formed from the top (rough) side of the filler grip piece or from the bottom side of the filler grip piece. If the latter, then the laser tool must be controlled in an appropriate manner because the mirror image of the written string/design will be viewable after the filler grip piece is affixed to the surface of the object. Moreover, it may be necessary to avoid creating designs or characters with closed loop features—otherwise, separable pieces from the filler grip piece may fall out. In this regard, the power of the laser may be scaled back to ensure that the writing procedure does not completely cut through the entire thickness of the filler grip piece.

In summary, materials, articles, and methods configured in accordance with embodiments of the invention relate to:

A sheet of nonskid adhesive material comprising: a primary grip layer having a rough upper surface and a sticky lower surface opposite its rough upper surface, the primary grip layer having a negative space pattern formed therein; an adhesive patch layer having an upper surface affixed to a first portion of the sticky lower surface of the primary grip layer, and having a sticky lower surface opposite its upper surface; and a filler grip piece having a rough upper surface and a sticky lower surface opposite its rough upper surface, the sticky lower surface of the filler grip piece being affixed to the upper surface of the adhesive patch layer, and the filler grip piece being located within the negative space pattern. The sheet of nonskid adhesive material may further comprise a removable backing adhered to a second portion of the sticky lower surface of the primary grip layer. The sheet of nonskid adhesive material may further comprise a removable backing adhered to the sticky lower surface of the adhesive patch layer. The upper surface of the sheet of nonskid adhesive material can be non-sticky. In one embodiment, the filler grip piece is translucent and the upper surface of the adhesive patch layer is colored to enhance a translucence effect of the filler grip piece. For some embodiments, the upper surface of the adhesive patch layer is white. The adhesive patch layer may span the negative space pattern. In certain embodiments, the filler grip piece fills the negative space pattern. The rough upper surface of the primary grip layer can have a first color, while the rough upper surface of the filler grip piece can have a second color. In addition, the adhesive patch layer can be translucent and colorless, transparent and colorless, translucent and colored, or transparent and colored, and the filler grip piece can be translucent and colorless, transparent and colorless, translucent and colored, or transparent and colored.

A sheet of nonskid adhesive material comprising: a primary grip layer having at least one negative space pattern formed therein; at least one filler grip piece corresponding to the at least one negative space pattern; and at least one adhesive patch layer, each having an upper surface and an adhesive lower surface, the upper surface having a first area affixed to the primary grip layer, and the upper surface having a second area affixed to the at least one filler grip piece. At least one negative space pattern may include a plurality of separate and distinct negative space patterns. The at least one filler grip piece may include a plurality of separate and distinct filler grip pieces. The number of negative space patterns may equal the number of filler grip pieces.

A sheet of nonskid adhesive material comprising: a primary grip layer having a rough upper surface and a sticky lower surface, the primary grip layer having a negative space pattern formed therein; a filler grip piece having a rough upper surface and a sticky lower surface, the filler grip piece being located within the negative space pattern; an adhesive patch layer having an upper surface and a sticky lower surface, the upper surface of the adhesive patch layer having a first section affixed to a first area of the sticky lower surface of the primary grip layer, and the upper surface of the adhesive patch layer having a second section affixed to the sticky lower surface of the filler grip piece; a removable primary backing coupled to a second area of the sticky lower surface of the primary grip layer; and a removable patch backing coupled to the sticky lower surface of the adhesive patch layer.

A sheet of nonskid adhesive material comprising: a primary grip layer having a negative space pattern formed therein; a filler grip piece located within the negative space pattern; an adhesive patch layer having an upper surface affixed to a portion of the primary grip layer, and having a sticky lower surface; and a graphics layer located between the filler grip piece and the upper surface of the adhesive patch layer, the graphics layer having an upper surface and a graphic feature on its upper surface, wherein the graphic feature is at least partially visible through the filler grip piece. In one embodiment, the graphics layer has a first portion and a second portion, the first portion is located between the primary grip layer and the upper surface of the adhesive patch layer, the second portion is located between the filler grip piece and the adhesive patch layer, and the graphic feature is located on the second portion. The filler grip piece can be translucent to facilitate visibility of the graphic feature. The filler grip piece can be transparent to facilitate visibility of the graphic feature. The filler grip piece may be colorless or it may be colored and translucent. The sheet of nonskid adhesive material may further comprise a removable primary backing coupled to a sticky lower surface of the primary grip layer, and a removable patch backing adhered to the sticky lower surface of the adhesive patch layer. In one embodiment, the upper surface of the adhesive patch layer is non-sticky. The adhesive patch layer may span the negative space pattern. The filler grip piece may fill the negative space pattern. The adhesive patch layer can be translucent and colorless, transparent and colorless, translucent and colored, or transparent and colored.

A method for producing a sheet of nonskid adhesive material with a graphics component, the method comprising: providing a sheet of grip tape comprising a primary grip layer having a sticky lower surface and a removable primary backing coupled to the sticky lower surface; perforating or cutting the removable primary backing, without cutting through the primary grip layer, to define a patch section in the sheet of grip tape; perforating or cutting the sheet of grip tape in an area within the patch section to define a negative space pattern; removing a first portion of the removable primary backing from the patch section, while leaving in place a second portion of the removable primary backing corresponding to the negative space pattern, to reveal an exposed section of the sticky lower surface of the primary grip layer; and affixing an adhesive patch layer to the exposed section. The adhesive patch layer may be translucent and colorless, transparent and colorless, translucent and colored, or transparent and colored. The method may further comprise trimming the adhesive patch layer to match the size of the patch section. The adhesive patch layer typically has an upper surface, a sticky lower surface, and a removable patch backing coupled to its lower sticky surface. The method may further comprise removing a scrap piece from the sheet of grip tape, the scrap piece representing a positive pattern corresponding to the negative space pattern. The method may further comprise locating a filler grip piece within the negative space pattern. The primary grip layer may be a first color, while the filler grip piece is a second color. The primary grip layer may be translucent. The filler grip piece may be translucent. For one embodiment of the method: the adhesive patch layer is translucent and colorless, transparent and colorless, translucent and colored, or transparent and colored; and the filler grip piece is translucent and colorless, transparent and colorless, translucent and colored, or transparent and colored. The method may further comprise: removing a scrap piece from the sheet of grip tape, the scrap piece representing a positive pattern corresponding to the negative space pattern, resulting in an exposed area of the adhesive patch layer, the exposed area corresponding to the negative space pattern; and affixing a filler grip piece to the exposed area. The method may further comprise forming the filler grip piece such that it represents the positive pattern.

A method for producing a sheet of nonskid adhesive material with a graphics component, the method comprising: providing a sheet of grip tape comprising a primary grip layer having a sticky lower surface and a removable primary backing coupled to the sticky lower surface; perforating or cutting the removable primary backing, without cutting through the primary grip layer, to define a patch section in the sheet of grip tape; perforating or cutting the sheet of grip tape in an area within the patch section to define a negative space pattern; removing a first portion of the removable primary backing from the patch section, while leaving in place a second portion of the removable primary backing corresponding to the negative space pattern, to reveal an exposed section of the sticky lower surface of the primary grip layer; providing a graphics layer having an upper surface, a lower surface, and a graphic feature on its upper surface; positioning the graphics layer such that the graphic feature faces the second portion of the removable primary backing; and affixing an adhesive patch layer to the exposed section. The method may further comprise trimming the adhesive patch layer to match the size of the patch section. The adhesive patch layer can have an upper surface, a sticky lower surface, and a removable patch backing coupled to its sticky lower surface. The adhesive patch layer may be translucent and colorless, transparent and colorless, translucent and colored, or transparent and colored. The method may further comprise removing a scrap piece from the sheet of grip tape, the scrap piece representing a positive pattern corresponding to the negative space pattern. The method may further comprise locating a filler grip piece within the negative space pattern. The filler grip piece can be translucent and colorless, transparent and colorless, translucent and colored, or tinted. In some embodiments, the primary grip layer is black and the filler grip piece is translucent and colorless. The method may further comprise forming the filler grip piece such that it represents the positive pattern. In one embodiment: the adhesive patch layer is translucent and colorless, transparent and colorless, translucent and colored, or transparent and colored; and the filler grip piece is translucent and colorless, transparent and colorless, translucent and colored, or transparent and colored. The method may further comprise: removing a scrap piece from the sheet of grip tape, the scrap piece representing a positive pattern corresponding to the negative space pattern, resulting in an exposed area of the upper surface of the graphics layer, the exposed area corresponding to the negative space pattern; and affixing a filler grip piece to the exposed area, the filler grip piece being configured to facilitate visibility of the graphic feature. The graphics feature may influence the step of perforating or cutting the sheet of grip tape in an area within the patch section to define a negative space pattern. In addition, the size and shape of the negative space pattern can be based upon the graphics feature. In one embodiment: the graphics layer is larger in area than the negative space pattern; and the step of positioning the graphics layer positions the graphics layer such that the upper surface of the graphics layer covers the negative space pattern and such that a section of the upper surface of the graphics layer is affixed to the exposed section of the sticky lower surface of the primary grip layer. In another embodiment of the method: the lower surface of the graphics layer is a sticky lower surface; the graphics layer includes a removable graphics layer backing coupled to its sticky lower surface; the method further comprises removing the removable graphics layer backing prior to the affixing step; and the affixing step affixes the adhesive patch layer to the exposed section and to the sticky lower surface of the graphics layer.

A grip tape kit comprising: a primary grip layer having a negative space pattern formed therein; a scrap grip piece residing within the negative space pattern; and an adhesive patch layer having an upper surface and an adhesive lower surface. The scrap grip piece comprises: a scrap grip layer having a rough upper surface and an sticky lower surface; and a removable scrap backing coupled to the sticky lower surface of the scrap grip layer. For the adhesive patch layer, the upper surface has a first area affixed to the primary grip layer, and the upper surface has a second area adjacent to the removable scrap backing. The adhesive patch layer can be translucent and colorless, transparent and colorless, translucent and colored, or transparent and colored. The kit may further comprise a filler grip piece sized and shaped in accordance with the negative space pattern. The filler grip piece may comprise: a filler grip layer having a rough upper surface and a sticky lower surface; and a removable filler backing coupled to the sticky lower surface of the filler grip piece. The filler grip piece can be sized and shaped to fill the negative space pattern. In certain embodiments the primary grip layer has a first visual characteristic, and the filler grip piece has a second visual characteristic that is distinguishable from the first visual characteristic. In one embodiment: the adhesive patch layer is translucent and colorless, transparent and colorless, translucent and colored, or transparent and colored; and the filler grip piece is translucent and colorless, transparent and colorless, translucent and colored, or transparent and colored. The rough upper surface of the primary grip layer may be a first color, while the rough upper surface of the filler grip piece is a second color. The kit may further comprise a second filler grip piece sized and shaped in accordance with the negative space pattern, wherein the filler grip piece and the second filler grip piece have visually distinguishable characteristics. In another embodiment, the filler grip piece is a first color and the second filler grip piece is a second color. In another embodiment, the filler grip piece has a first translucence characteristic, and the second filler grip has a second translucence characteristic. The removable scrap backing need not be affixed to the upper surface of the adhesive patch layer. The scrap grip piece can be perforated from the primary grip layer. The scrap grip piece and the negative space pattern can be defined by a through cut pattern in the primary grip layer.

A method for producing an adhesive antiskid sheet with a graphics component, the method comprising: providing a sheet of grip tape comprising a primary grip layer having a sticky lower surface and a removable primary backing coupled to the sticky lower surface; perforating or cutting the removable primary backing, without cutting through the primary grip layer, to define a patch section in the sheet of grip tape; perforating or cutting the sheet of grip tape in an area within the patch section to define a negative space pattern; removing a first portion of the removable primary backing from the patch section, while leaving in place a second portion of the removable primary backing corresponding to the negative space pattern, to reveal an exposed section of the sticky lower surface of the primary grip layer; affixing an adhesive patch layer to the exposed section; removing a scrap piece from the sheet of grip tape, the scrap piece representing a positive pattern corresponding to the negative space pattern, resulting in an exposed area of the adhesive patch layer, the exposed area corresponding to the negative space pattern; providing a graphics layer having an upper surface, a lower surface, and a graphic feature on its upper surface; and positioning the graphics layer such that its lower surface faces the exposed area of the adhesive patch layer. The method may further comprise affixing a filler grip piece over the upper surface of the graphics layer, the filler grip piece being configured to facilitate visibility of the graphic feature.

While at least one exemplary embodiment has been presented in the foregoing detailed description, it should be appreciated that a vast number of variations exist. In particular, the specific insert objects described above are not intended to limit the invention and are not exhaustive of the possible insert objects that can be employed in a practical embodiment. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A sheet of adhesive antiskid material comprising:

a primary grip layer having a rough upper surface and an adhesive lower surface opposite its rough upper surface, the primary grip layer having a negative space pattern formed therein;

a filler grip piece having a rough upper surface and an adhesive lower surface opposite its rough upper surface, the filler grip piece being located within the negative space pattern;

removable backing adhered to a first portion of the adhesive lower surface of the primary grip layer, wherein a remaining second portion of the adhesive lower surface of the primary grip layer defines a patch section;

a flexible adhesive-backed sheet having a non-adhesive and smooth upper surface affixed to the second portion of the adhesive lower surface of the primary grip layer and affixed to the adhesive lower surface of the filler grip piece, and the flexible adhesive-backed sheet having an adhesive lower surface opposite its non-adhesive and smooth upper surface, wherein the flexible adhesive-backed sheet matches the area defined by the patch section; and removable patch backing adhered to the adhesive lower surface of the flexible adhesive-backed sheet.

2. A sheet of adhesive antiskid material according to claim 1, wherein:

the filler grip piece is translucent; and the non-adhesive and smooth upper surface of the flexible adhesive-backed sheet is colored to enhance a translucence effect of the filler grip piece.

3. A sheet of adhesive antiskid material according to claim 2, wherein the non-adhesive and smooth upper surface of the flexible adhesive-backed sheet is white.

4. A sheet of adhesive antiskid material according to claim 1, wherein the flexible adhesive-backed sheet spans the negative space pattern.

5. A sheet of adhesive antiskid material according to claim 1, wherein:

the rough upper surface of the primary grip layer has a first color; and the rough upper surface of the filler grip piece has a second color.

6. A sheet of adhesive antiskid material comprising:

a primary grip layer having a rough upper surface and an adhesive lower surface opposite its rough upper surface, the primary grip layer having a negative space pattern formed therein;

a translucent filler grip piece having a rough upper surface and an adhesive lower surface opposite its rough upper surface, the translucent filler grip piece being located within the negative space pattern;

a graphics layer having an upper surface with a graphic feature thereon, and an adhesive lower surface opposite its upper surface, wherein the graphic feature is at least partially visible through the translucent filler grip piece;

removable backing adhered to a first portion of the adhesive lower surface of the primary grip layer, wherein a remaining second portion of the adhesive lower surface of the primary grip layer defines a patch section;

a flexible adhesive-backed sheet having a non-adhesive and smooth upper surface affixed to the second portion of the adhesive lower surface of the primary grip layer and affixed to the adhesive lower surface of the graphics layer, and the flexible adhesive-backed sheet having an adhesive lower surface opposite its non-adhesive and smooth upper surface, wherein the flexible adhesive-backed sheet matches the area defined by the patch section; and removable patch backing adhered to the adhesive lower surface of the flexible adhesive-backed sheet.

7. A sheet of adhesive antiskid material according to claim 6, wherein:

the graphics layer has a first portion and a second portion;

the first portion of the graphics layer is located between the primary grip layer and the non-adhesive and smooth upper surface of the flexible adhesive-backed sheet;

the second portion of the graphics layer is located between the filler grip piece and the flexible adhesive-backed sheet; and the graphic feature is located on the second portion of the graphics layer.

8. A sheet of adhesive antiskid material according to claim 6, wherein the filler grip piece is translucent to facilitate visibility of the graphic feature.

9. A sheet of adhesive antiskid material according to claim 6, wherein the filler grip piece is colorless.

10. A method of manufacturing a sheet of adhesive antiskid material, the method comprising:

providing a base sheet of adhesive antiskid material having a rough upper surface, an adhesive lower surface opposite its rough upper surface, and removable backing adhered to its adhesive lower surface;

cutting the removable backing to define a patch section in the base sheet;

cutting through the base sheet and its removable backing to define a negative space pattern therein, wherein the negative space pattern resides in an area within the patch section;

after cutting the removable backing and cutting through the base sheet and its removable backing, removing a portion of the removable backing from the patch section, while leaving in place another portion of the removable backing that corresponds to the negative space pattern, to reveal an exposed section of the adhesive lower surface of the base sheet;

after removing the portion of the removable backing from the patch section, affixing a non-adhesive and smooth upper surface of a flexible adhesive-backed sheet to the exposed section of the adhesive lower surface of the base sheet, wherein the flexible adhesive-backed sheet has an adhesive lower surface opposite its non-adhesive and smooth upper surface, wherein the flexible adhesive-backed sheet has removable backing adhered to its adhesive lower surface, and wherein the flexible adhesive-backed sheet is sized to match the patch section;

removing a scrap piece from the base sheet, the scrap piece representing a positive pattern corresponding to the negative space pattern cut through the base sheet, to expose a filler area of the flexible adhesive-backed sheet that corresponds to the negative space pattern; and affixing an adhesive lower surface of a filler grip piece to the filler area of the flexible adhesive-backed sheet such that the filler grip piece fills the negative space pattern, wherein the filler grip piece has a rough upper surface opposite its adhesive lower surface.

* * * * *